US010442185B2

(12) United States Patent
Kylling et al.

(10) Patent No.: US 10,442,185 B2
(45) Date of Patent: Oct. 15, 2019

(54) CLEANING ARRANGEMENT AND METHOD FOR CLEANING A FLEXOGRAPHIC COATING UNIT

(71) Applicant: Tresu A/S, Bjert (DK)

(72) Inventors: Mads Kylling, Haderslev (DK); Marko Ryynänen, Pulp (FI); Erik Gydesen, Bjert (DK); Petri Sirviö, Imatra (FI)

(73) Assignee: TRESU A/S, Bjert (DK)

( * ) Notice: Subject to any disclaimer, the term of this patent is extended or adjusted under 35 U.S.C. 154(b) by 680 days.

(21) Appl. No.: 14/396,911

(22) PCT Filed: Apr. 23, 2013

(86) PCT No.: PCT/EP2013/058368

§ 371 (c)(1),
(2) Date: Oct. 24, 2014

(87) PCT Pub. No.: WO2013/160288

PCT Pub. Date: Oct. 31, 2013

(65) Prior Publication Data

US 2015/0083162 A1 Mar. 26, 2015

(30) Foreign Application Priority Data

Apr. 24, 2012 (FI) ..... 20125448

(51) Int. Cl.
*B41F 35/02* (2006.01)
*B41F 33/16* (2006.01)
(Continued)

(52) U.S. Cl.
CPC ..... *B41F 35/02* (2013.01); *B05C 1/00* (2013.01); *B05C 11/00* (2013.01); *B41F 23/08* (2013.01);
(Continued)

(58) Field of Classification Search
None
See application file for complete search history.

(56) References Cited

U.S. PATENT DOCUMENTS 4,344,361 A 8/1982 MacPhee et al.
4,757,763 A 7/1988 MacPhee et al.
(Continued)

FOREIGN PATENT DOCUMENTS

CN 101310978 A 11/2008
CN 101348036 A 1/2009
(Continued)

*Primary Examiner* — Eric W Golightly
*Assistant Examiner* — Arlyn I Rivera-Cordero
(74) *Attorney, Agent, or Firm* — David S. Safran; Roberts Mlotkowski Safran Cole & Calderon, P.C.

(57) ABSTRACT

A cleaning arrangement for a coater that has a plate cylinder, the cleaning arrangement having a cleaning web, a tangential moving mechanism configured to controllably move the cleaning web in at least one direction in a plane defined by the cleaning web, a radial moving mechanism configured to controllably move the cleaning web in at least one direction out of the plane, and a controller coupled to the tangential and radial moving mechanisms which is configured to control the moving of the cleaning web into and out of contact with the plate cylinder in conformity with input signals received by the controller.

8 Claims, 3 Drawing Sheets

(51) Int. Cl.

| | |
|---|---|
| ***B41F 35/00*** | (2006.01) |
| ***B41F 23/08*** | (2006.01) |
| ***B05C 1/00*** | (2006.01) |
| ***B05C 11/00*** | (2006.01) |

(52) U.S. Cl.
CPC ..... *B41F 33/16* (2013.01); *B41F 35/00* (2013.01); *B41P 2235/242* (2013.01); *B41P 2235/244* (2013.01); *B41P 2235/246* (2013.01); *B41P 2235/26* (2013.01)

(56) References Cited

U.S. PATENT DOCUMENTS

| | | | | |
|---|---|---|---|---|
| 5,367,955 | A | 11/1994 | Hara et al. | |
| 5,598,777 | A | 2/1997 | Demoore et al. | |
| 5,758,577 | A | 6/1998 | Ebina | |
| 7,726,240 | B2 | 6/2010 | Saito et al. | |
| 8,011,300 | B2 * | 9/2011 | Cyman, Jr. | B41C 1/105 101/450.1 |
| 8,590,449 | B2 | 11/2013 | Egan | |
| 2002/0112618 | A1 * | 8/2002 | Bailey | B41F 19/062 101/2 |
| 2002/0139268 | A1 * | 10/2002 | Emery | B41F 35/00 101/425 |
| 2010/0011980 | A1 | 1/2010 | Grandt et al. | |
| 2010/0284713 | A1 * | 11/2010 | Li | G03G 15/2064 399/328 |

FOREIGN PATENT DOCUMENTS

| | | | |
|---|---|---|---|
| CN | 201186515 | Y | 1/2009 |
| DE | 4444453 | A1 | 6/1996 |
| DE | 10 2004 002 521 | A1 | 8/2005 |
| DE | 10 2004 062 114 | A1 | 7/2006 |
| DE | 10 2008 020 393 | A1 | 10/2009 |
| DE | 20 2010 007 499 | U1 | 10/2010 |
| GB | 2 297 719 | A | 8/1996 |
| JP | 09-099549 | A | 4/1997 |
| JP | 10-095104 | A | 4/1998 |
| JP | 2007-015183 | A | 1/2007 |
| JP | 2007-225846 | A | 9/2007 |
| JP | 2008-307716 | A | 12/2008 |
| JP | 2012-020445 | A | 2/2012 |

* cited by examiner

CLEANING ARRANGEMENT AND METHOD FOR CLEANING A FLEXOGRAPHIC COATING UNIT

BACKGROUND OF THE INVENTION

Field of the Invention

The invention concerns, in general, the technology of automatic maintenance operations in printing and package manufacturing machinery. Especially the invention concerns the task of maintaining smooth and reliable operation of a coater that on a manufacturing line comes after a sheet-fed printer.

Description of Related Art

Many manufacturing processes involve handling workpieces initially in planar, sheet-like form. As an example, the manufacturing process of packages is considered. The manufacturing process is typically arranged so that it takes advantage of the relatively easy handling of workpieces at the stage when they are still in planar form. A typical process for manufacturing cardboard packages comprises at least a printer, a stacker, and a die cutter in this order. Coaters, dryers, and/or other arrangements may follow the printer for implementing steps that, from the viewpoint of printing, represent post-processing. As an example, a coater may be disposed directly after the printer to apply a layer of water- or solvent-based varnish over at least parts of the printed surface.

At the time of writing this description, the printer is more and more often a sheet-fed digital printer, capable of flexibly enabling short series production and making fast changes to at least parts of the printed pattern(s) even after each workpiece. Compared to the relatively long and regular runs made with traditional web-fed printing presses, print works executed with a sheet-fed digital printer are frequently characterized by irregular output, meaning that pauses of variable duration may occur between consecutive workpieces and series of workpieces that come out of the printer. A consequence of the flexibility of the printer is a requirement for also the subsequent machinery to adapt their operation to the irregularities in operation.

As an example, we may consider a flexographic coating unit like the one schematically illustrated in FIG. 1. Printed sheets come from the left in the drawing, pass between a plate cylinder 101 and an impression cylinder 102, and continue to the right in the drawing to be stacked and/or transported further to die-cutting. An inking arrangement, shown schematically to comprise a fountain roller 103 and an anilox roller 104 in FIG. 1, is used to dose varnish or some other coating substance onto the surface of the plate cylinder 101. Some kind of transport arrangement is needed in order to keep the workpieces moving, because unlike the material web in web-fed processes, the sequence of separate sheet-like workpieces cannot be drawn from ends. In FIG. 1, vacuum belts 105 have been illustrated as an example of a transport arrangement.

If the coating substance is to be applied in specific patterns, the mirror images of corresponding patterns have been formed in positive (as elevated areas) on the surface of the plate cylinder. The coating substance then only becomes spread on the elevated areas, and consequently forms the desired patterns on the printed surface when the surface of the plate cylinder presses against the appropriate workpiece. The "printing plate", as the outmost surface layer of the plate cylinder is called, is made of flexible material such as a selectively hardened light-sensitive polymer, which explains the descriptor "flexographic".

For obvious reasons, the varnish or other coating substance must dry relatively quickly, although a dryer may follow the coater to expedite drying. An exposed layer of a typical water-based varnish used in cardboard packages becomes leathery in just tens of seconds, and completely solid only shortly thereafter. On the surfaces of the workpieces, quick drying of the coating substance is an advantage. However, on the surface of the plate cylinder it may cause problems, especially if the output rate of workpieces from the printer is irregular.

From German Utility Model DE202010007499U1, and German Patent Applications DE102004062114A1 and DE102008020393A1 various general cleaning arrangements for cylinders are known.

SUMMARY OF THE INVENTION

An objective of the present invention is to present a cleaning arrangement, a coater, and a method for cleaning a coater that would facilitate flexible handling of sheet-fed workpieces. Another objective of the present invention is to make the coater adapt to the possibly irregular output rate of workpieces from a digital printer. Yet another objective of the invention is to ensure high-quality coating of irregularly fed workpieces. Yet another objective of the invention is to minimize the need for user intervention in the machine parts that follow a digital printer on a manufacturing line.

These and further advantages can be achieved by using a cleaning arrangement that comprises a cleaning web as well as moving mechanisms for moving the cleaning web both tangentially and radially with respect to a plate cylinder of the coater. A wetting arrangement can be used to selectively wet portions of the cleaning web. Remnants of the wetting liquid can be removed from the surface of the plate cylinder with pressurized air. For the last-mentioned purpose, there can be used a blower nozzle, the other task of which is to ensure the detaching of a front end of a passing workpiece from the outer surface of the plate cylinder.

The exemplary embodiments of the invention presented in this patent application are not to be interpreted to pose limitations to the applicability of the invention. The verb "to comprise" is used in this patent application as an open limitation that does not exclude the existence of also unrecited features.

The invention, both as to its construction and its method of operation, together with additional objects and advantages thereof, will be best understood from the following description of specific embodiments when read in connection with the accompanying drawings.

DETAILED DESCRIPTION OF THE INVENTION

Figure 1:
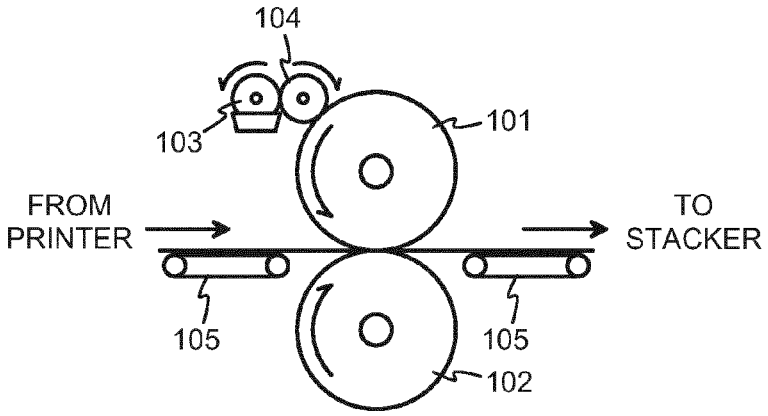
FIG. 1 PRIOR ART
FIG. 1 illustrates a prior art coater.
Figure 2:
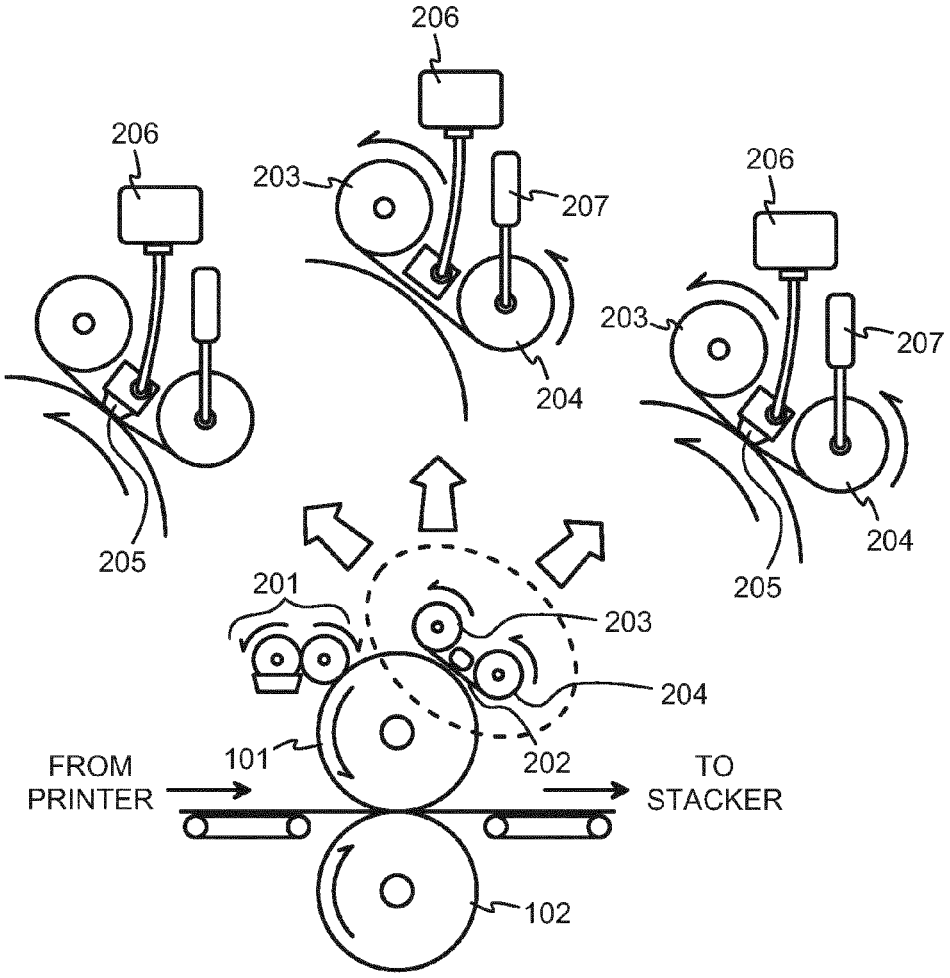
FIG. 2 illustrates a coater according to an embodiment of the invention, with detail illustrations of three steps of using a cleaning arrangement according to an embodiment of the invention.

FIG. 2 illustrates schematically a coater, and especially a cleaning arrangement for a coater. The coater comprises a plate cylinder 101, which as a general description means a rotatable cylindrical body, the outer surface of which is meant to press against a workpiece in the purpose of transferring coating substance, which has been previously spread on said outer surface, onto desired portions of the surface of the workpiece. Means for spreading the coating substance on the outer surface of the plate cylinder are schematically shown at 201 in FIG. 2, and they can comprise a fountain roller and an anilox roller or they may be implemented otherwise, for example, with only an anilox roller without a separate fountain roller. The way in which the coating substance is spread on the outer surface of the plate cylinder 101 is not important to the present invention. An impression cylinder 102 is also shown in FIG. 2. Together with the plate cylinder 101, the impression cylinder or a corresponding counterpart forms the nip in which the transferring of coating substance from the outer surface to the surface of the workpiece takes place.

The cleaning arrangement comprises a cleaning web, which in the embodiment of FIG. 2 is an elongated piece of relatively soft and porous material. The softness of the material is defined so that pressing it against the outer surface of the plate cylinder, i.e., against the flexographic printing plates or other means that define the areas on which the coating substance will be spread, and rotating the plate cylinder 101, does not cause significant wear or other damage to the outer surface even during multiply repeated use over the period of using that particular printing plate. The porosity of the material will be described in more detail later. The fact that the piece of material that constitutes the cleaning web is relatively long is perceivable in FIG. 2 by noting that both of its ends have been wound on rollers. The function of these rollers will be described in more detail later.

The cleaning arrangement also comprises a tangential moving mechanism, the task of which is to controllably move the cleaning web in at least one direction in a plane defined by the cleaning web. In the embodiment of FIG. 2, said plane is defined by the portion 202 of the cleaning web that is drawn between the two rollers. The tangential moving mechanism comprises two rollers, which can be called a feed roller 203 and a spool 204, and any motors, gears, and the like that are used to rotate them. The feed roller 203 and spool 204 are parallel to each other, so cleaning web unwound from the feed roller 203 can be wound onto the spool 204. This implements an example of the movement in the plane defined by the portion 202 of the cleaning web that is drawn between the feed roller 203 and spool 204. By moving the feed roller 203 and the spool 204 in their axial direction, another example of a movement of said kind could be implemented, although if the width of the cleaning web is essentially the same as the length of the plate cylinder 101, there may be little need for such axial movement. The plane of these directions is parallel to a fictitious tangential plane of the plate cylinder 101; hence the designation "tangential moving mechanism".

Additionally, the cleaning arrangement comprises a radial moving mechanism that is configured to controllably move the cleaning web in at least one direction that is not within said plane, i.e., out of the plane defined by the portion 202 of the cleaning web that is drawn between the two rollers. An example of a radial moving mechanism comprises an inflatable cushion 205 on the back surface side of the cleaning web, and a controllable valve 206 for inflating and deflating said inflatable cushion 205. The surface of the cleaning web that comes against the plate cylinder is called the cleaning surface, so the back surface is the opposite surface. These surfaces may well be the surfaces of a single, unitary layer of cleaning web material, although it is also possible to use a multilayer material for the cleaning web.

As an alternative to an inflatable cushion, the radial moving mechanism could comprise, for example, a movable blade, a movable roller, and/or a movable pad on the back surface side of the cleaning web. Any of these could be used to controllably press the cleaning web against an outer surface of a plate cylinder and to temporarily detach the cleaning web from the outer surface of the plate cylinder as needed. The movement considered here takes place essentially in the radial direction of the plate cylinder; hence the designation "radial moving mechanism".

The upper part of FIG. 2 illustrates three exemplary steps of using the cleaning arrangement. In the leftmost illustration, the plate cylinder rotates and the inflatable cushion 205 has been inflated. As a consequence, that portion of the cleaning web that is currently located under the inflatable cushion 205 is pressed against and sweeps across the outer surface of the plate cylinder. In the middle illustration, the inflatable cushion has been deflated (by using the controllable valve 206 to allow air to escape and/or to actively draw air out), causing the cleaning web to detach from the outer surface of the plate cylinder. A motor 207 is operated to wind a used portion of the cleaning web onto the spool 204. Simultaneously, the drawing force coming from the motor unwinds a fresh, unused portion of cleaning web from the feed roller 203. This is the movement of the cleaning web in one direction in a plane defined by the cleaning web, which was explained above.

When an unused portion of the cleaning web has been drawn under the inflatable cushion, the cleaning arrangement is ready for another cleaning sweep of the kind shown in the leftmost illustration. Whether the plate cylinder rotates or not during the winding of the cleaning web, is not important. Directions of rotation are represented by arrows.

The rightmost illustration at the upper part of FIG. 2 illustrates the possibility of using the tangential moving mechanism and the radial moving mechanism simultaneously. The plate cylinder rotates, the inflatable cushion 205 is inflated, and the motor 207 winds used cleaning web onto the spool 204 and unwinds unused cleaning web from the feed roller 203. This way that portion of the cleaning web that is against the plate cylinder surface is changed (renewed) all the time, which may improve the obtained cleaning result.

In the embodiment shown in the rightmost illustration at the upper part of FIG. 2, but also in other embodiments of the invention, it can be seen that directing the tangential movement of the cleaning web against the direction in which the surface of the plate cylinder moves during rotation is advantageous. This way it can be ensured that the cleanest, most recently unwound portion of the cleaning web comes against the surface of the plate cylinder where most of the remnants of the coating substance have already been swept away by the preceding, already dirtier portions of the cleaning web.

Since the aim of the cleaning is to absorb, from the outer surface of the plate cylinder, remnants of coating substance that are not usable any more for coating any incoming workpiece, the porosity of the cleaning web comes into question. It is advantageous to make the cleaning web of a material that is porous enough to allow remnants of the coating substance to be absorbed.

It has been found that for more efficient cleaning, it may be advantageous to wet a portion of the cleaning web with a liquid that acts as a solvent for the coating substance. For example, if water-based varnish is used as a coating substance, the wetting liquid may be water. Similarly if the coating substance is soluble for example, in some organic solvent, that solvent may be used as a wetting liquid. If wetting is used, it sets another requirement for porosity: the material of the cleaning web must be porous enough to allow the wetting liquid to spread within it. If wetting liquid is dosed on the back surface of the cleaning web, the material must be porous enough to allow sufficient quantities of the wetting liquid to diffuse through the cleaning web to its cleaning surface so that the wetting liquid is able to perform its task in dissolving coating substance from the surface of the plate cylinder.

Examples of materials that can be used for the cleaning web comprise, but are not limited to, tissue materials that at the time of writing this description are available from Baldwin Technology Company, Inc., 8040 Forsyth Blvd, St. Louis, Mo. 63105, USA. A person skilled in the art, having knowledge of such tissue materials and having been advised of their applicability to the cleaning arrangement described here, could also consider other cleaning web materials.

Figure 3:
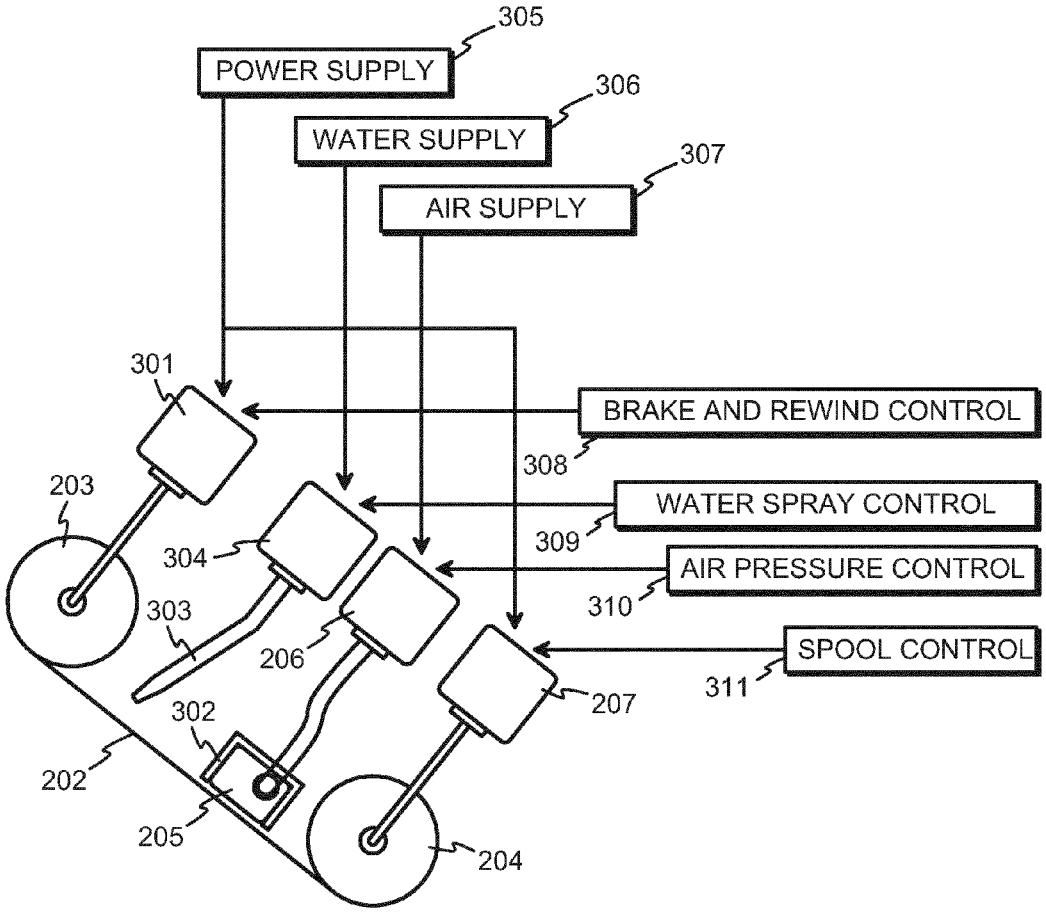
FIG. 3 illustrates the cleaning arrangement according to an embodiment of the invention.

FIG. 3 illustrates a cleaning arrangement that comprises wetting means. Similar to the embodiment shown in FIG. 2, the tangential moving mechanism comprises a feed roller 203, a spool 204 parallel to said feed roller, and a motor 207 configured to rotate at least the spool 204 for winding cleaning web unwound from the feed roller 203 onto the spool 204. In the embodiment of FIG. 3, another motor 301 is provided for affecting the rotating movement of the feed roller 203. The motor 301 can be used for braking (in order to control the rate at which cleaning web is unwound) and/or for rewinding, for example, if a completely used cleaning web should be rewound back onto the sleeve on which it came before changing.

Also, similar to the embodiment of FIG. 2, the radial moving mechanism comprises an inflatable cushion 205 on the back surface side of the cleaning web, and a controllable valve 206 for inflating and deflating the inflatable cushion 205. In this embodiment, the inflatable cushion is shown installed within a housing 302 in order to ensure that inflating the inflatable cushion causes it to bulge primarily in the direction in which it presses the cleaning web against the plate cylinder.

For implementing the wetting, the cleaning arrangement of FIG. 3 comprises one or more wetting nozzles 303, with an operating direction towards the cleaning web. The operating direction is the primary direction in which wetting liquid is ejected from a wetting nozzle. Since the cleaning web has a certain width in its transverse direction (the direction directly into the paper in FIG. 3), and since it is advantageous to wet the whole width of the cleaning cloth, it may be advantageous to use a nozzle with a significant dimension in the transverse direction, and/or a number of nozzles located next to each other in said transverse direction. As an alternative to nozzles and ejecting, the dosing of the wetting liquid to the cleaning web could be implemented, for example, with a bleeding line located close enough to the cleaning web so that wetting liquid that bleeds out of the bleeding line becomes absorbed in the adjacent portion of the cleaning web.

In order to control the amount, rate, and timing of the application of wetting liquid to the cleaning web, the cleaning arrangement of FIG. 3 comprises a wetting liquid dosing arrangement 304 that is configured to controllably deliver wetting liquid through the one or more wetting nozzles towards the cleaning web. The wetting liquid dosing arrangement 304 may comprise, for example, a connection to a supply of pressurized water or other wetting liquid, as well as one or more controllable valves configured to control the flow of the wetting liquid from the supply to the nozzle(s). Alternatively, the wetting liquid dosing arrangement 304 may comprise a connection to a supply of unpressurized water or other wetting liquid, as well as a pump for creating the pressure that is needed to eject wetting liquid through the nozzle(s), and one or more controllable valves configured to control the flow of the wetting liquid from the pump to the nozzle(s).

If a wetting arrangement is used, it is advantageous to place it so that wetting of a portion of the cleaning web takes place either simultaneously or before that portion comes in contact with the outer surface of the plate cylinder. In the embodiment of FIG. 3, the one or more wetting nozzles 303 are located between the feed roller 203 and the spool 204, with the operating direction towards a planar portion 202 of the cleaning web drawn between the feed roller 203 and the spool 204. In the direction of movement of the cleaning web from the feed roller 203 towards the spool 204, the one or more wetting nozzles 303 are located before the radial moving mechanism, i.e., before the inflatable cushion 205.

Supply functions, i.e., the supply of driving (and braking) power 305, the supply of water or other wetting liquid 306, and the supply of air (or other inflating substance) 307 are shown schematically at the upper part of FIG. 3. Control functions, i.e., the control for braking and rewinding 308, the control for dosing water or other wetting liquid 309, the control for dosing air or other inflating substance 310, and the control for spooling the cleaning web 311 are shown schematically in the rightmost part of FIG. 3. The supply and control functions can be implemented in practice with means that are known as such from the technology of controlling printing processes.

The outer surface of the plate cylinder may comprise recesses, especially if there are areas of the workpieces that should not receive coating. Remnants of wetting liquid may remain in such recesses, even if a dry portion of the cleaning web would be used to sweep the surface of the plate cylinder after sweeping it with a wetted portion. For removing remnants of the wetting liquid (and also for removing dry dust, if any is encountered) from the outer surface of the plate cylinder, the cleaning arrangement may comprise one or more blower nozzles with an operating direction directed to a space faced to by the cleaning surface of the cleaning web. This definition of the operating direction is easier to understand, when it is reminded that the plate cylinder occupies that space; in other words, the operating direction of the blower nozzle(s) is towards the outer surface of the plate cylinder. Concerning the dimension and/or distribution of the blower nozzle(s) across the transverse width of the cleaning web, the same considerations apply as for the wetting nozzle(s).

Figure 4:
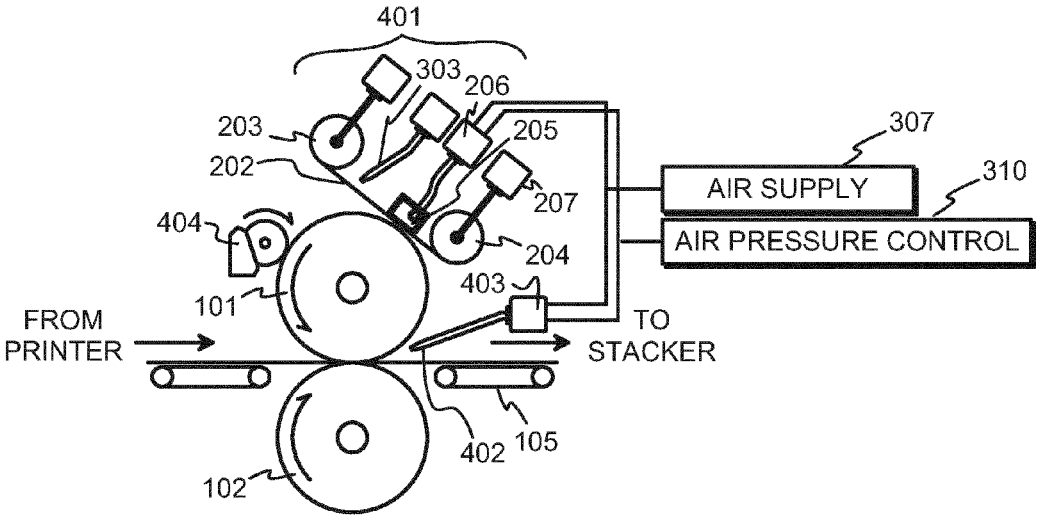
FIG. 4 illustrates a coater according to an embodiment of the invention.

FIG. 4 illustrates an advantageous double use of the one or more blower nozzles. In general, FIG. 4 illustrates a coater for spreading coating substance onto planar workpieces fed into the coater from the left, i.e., from a printer. The coater comprises a plate cylinder 101 for spreading said coating substance onto said workpieces, and a cleaning arrangement 401 according to an embodiment of the invention for cleaning an outer surface of said plate cylinder. In order to take full advantage of the cleaning of the plate cylinder, it is advantageous to equip the coater with means (not separately shown) for selectively disconnecting the means 404 for spreading the coating substance on the outer surface of the plate cylinder, and/or for otherwise interrupting the operation of the means 404. The last-mentioned means is schematically shown in FIG. 4 as comprising only a single roller and a dosing unit.

Before describing the double use of the blower nozzle(s), the spatial relations and purposes of some parts of the cleaning arrangement may be briefly recapitulated with reference to other parts of the coater in FIG. 4. The tangential moving mechanism comprises a feed roller 203, a spool 204 parallel to said feed roller 203, and a motor 207 configured to rotate at least said spool 204 for winding cleaning web unwound from said feed roller 203 onto said spool 204. The plane of tangential movement is defined by a portion 202 of the cleaning web drawn between the feed roller 203 and the spool 204. The portion 202 is parallel to a tangential plane of the plate cylinder 101, and is located at a distance from an outer surface of the plate cylinder 101. The cleaning web has a cleaning surface and a back surface, and the radial moving mechanism comprises an inflatable cushion 205 on the back surface side of said cleaning web, and a controllable valve 206 for inflating and deflating said inflatable cushion 205 so that when inflated, said cushion 205 is configured to press the cleaning surface of the cleaning web against the outer surface of the plate cylinder 101.

The cleaning arrangement comprises one or more wetting nozzles 303 with an operating direction towards said back surface. The one or more wetting nozzles are located between the feed roller 203 and the spool 204, with the operating direction towards the planar portion 202 of the cleaning web drawn between the feed roller 203 and the spool 204.

The cleaning arrangement of the coater seen in FIG. 4 comprises a blower nozzle 402 with an operating direction directed—obliquely—towards the outer surface of the plate cylinder 101. The double use of the blower nozzle 402, which was mentioned above, comes from the fact that the coater is configured to use the blower nozzle 402 to also ensure the detaching of a front end of a passing workpiece from the outer surface of the plate cylinder 101. It is noted that the coater illustrated schematically in FIG. 4 comprises vacuum belts 105 for transporting workpieces. However, in and close to the nip between the plate cylinder 101 and the impression cylinder 102 a workpiece is transported forwards solely through the rotating motion of said cylinders. Since the coating substance may be somewhat sticky at the moment of spreading it onto a workpiece, it is not unusual that it "glues" the workpiece to the outer surface of the plate cylinder. Thus, a workpiece coming out of the nip between the plate cylinder 101 and the impression cylinder 102 may have a tendency to not follow the intended rectilinear path onto the next vacuum belt 105, but to continue towards the upper right in FIG. 4, along with the rotating motion of the plate cylinder 101.

A momentary puff of pressurized air from the blower nozzle 402 implements a so-called air knife that ensures the detaching of a front end of a passing workpiece from the outer surface of the plate cylinder 101. For this purpose, it is important to time the puff of air correctly so that it hits exactly the front end of a passing workpiece. However, the cleaning of the outer surface of the plate cylinder is typically performed during a break in printing, when there are no workpieces coming through the coater. Thus, the use of pressurized air blown through the blower nozzle 402 may be timed more freely. If the whole "active" surface of the plate cylinder (meaning that portion of its outer surface that is actually used to transfer coating substance onto a workpiece) is cleaned with a cleaning arrangement that comprises wetting, it is advantageous to keep pressurized air coming through the blower nozzle 402 during the whole time interval when the active surface of a rotating plate cylinder turns past the blower nozzle 402.

For the sake of completeness, FIG. 4 also shows schematically a pressurized air dosing arrangement that is configured to controllably deliver pressurized air both to the inflatable cushion 205 and through the one or more blower nozzles 402—obliquely—towards the outer surface of the plate cylinder 101. The pressurized air dosing arrangement comprises the supply of air 307, the control for dosing air or other inflating substance 310, as well as the controllable valve 206 for inflating and deflating the inflatable cushion and the controllable valve 403 for dosing the air blown through the blower nozzle(s) 402.

Figure 5:
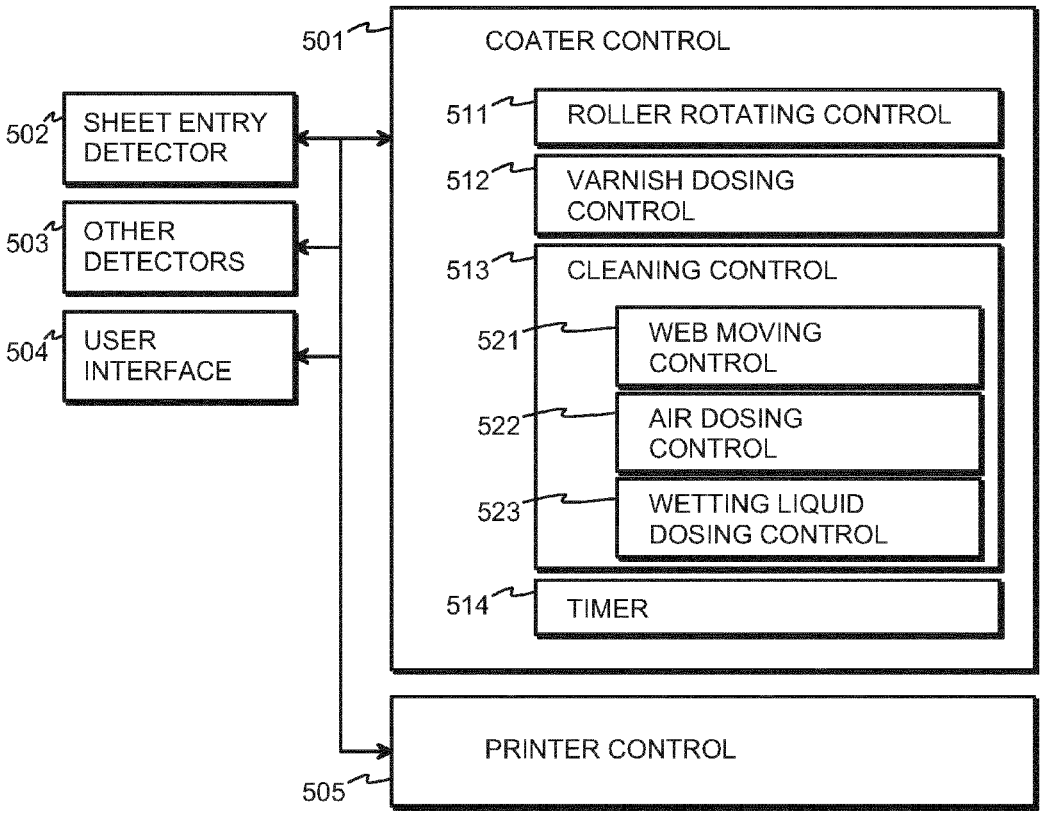
FIG. 5 is a flow chart describing implementation of various aspects of controlling, and, FIG. 6 illustrates a method according to an embodiment of the invention.

A method for cleaning a coating unit according to an embodiment of the invention is preferably implemented by making a programmable control arrangement execute a program comprising computer-readable instructions that, when executed by a computer, cause the implementation of the method. FIG. 5 illustrates some exemplary aspects of compiling such computer-readable instructions in the form of a control program that involves interaction with other executable programs and with hardware parts. Control of a coater is schematically illustrated as 501. It may receive inputs from a sensor 502 that detects an incoming sheet-like workpiece when it is entering or about to enter the coater, as well as other sensors and detectors schematically illustrated as 503. Also schematically illustrated is a user interface 504, through which a user may give commands that affect controlling the coater, and through which indications, prompts, and responses may be conveyed to a user. The control of a coater also advantageously interacts with the control functions governing the operation of other parts of the same manufacturing line, of which the printer control 505 is shown as an example in FIG. 5.

Controlling the coater involves controlling the rotation of all rollers and cylinders for the rotation of which there are control means, such as motors, gears, and/or brakes. Controlling the rotation of rollers and cylinders is schematically shown as 511. Also, since in this description we assume that the coater is utilized especially to spread varnish on sheet-like workpieces that are to become packages, controlling the dosing of the varnish is illustrated as 512. The dosing of varnish or other coating substance can be accomplished with means that are known as such from the technology of coaters as well as flexographic and other printers. For the purpose of the present invention, it is noted that it is advantageous to have the dosing of the coating substance interrupted (for example, by disconnecting a coating-substance-spreading roller from the plate cylinder) for those periods when the outer surface of the plate cylinder is cleaned. Thus, the part of controlling the coater that is schematically illustrated as 512 should allow temporarily interrupting the dosing of coating substance onto the plate cylinder as a response to a corresponding command from the control program.

Controlling the cleaning arrangement is schematically shown as 513. It comprises controlling the movements of the cleaning web, as illustrated in 521. Moving the cleaning web involves using a radial moving mechanism to press a cleaning web against an outer surface of the plate cylinder, and using a tangential moving mechanism in a direction tangential to said outer surface of the plate cylinder to bring an unused portion of said cleaning web to a location where it can be pressed against the outer surface of the plate cylinder. This part of the cleaning control should interact with the control of the rotating movements of the rollers and cylinders in 511, for rotating the plate cylinder to rub its outer surface against the cleaning web.

Air dosing control, illustrated as 522, can be used to controllably inflate and deflate an inflatable cushion, the inflating of which causes it to bulge outwards and consequently push the cleaning web against the plate cylinder. Also, the task of temporarily detaching the cleaning web from the outer surface of the plate cylinder goes under air dosing control, if an inflatable cushion is used, because said detaching is accomplished by deflating the inflatable cushion. If the cleaning arrangement comprises one or more blower nozzles, air dosing control 522 can additionally be used for removing remnant wetting liquid from the outer surface of the plate cylinder by blowing air towards the outer surface of the plate cylinder from said blower nozzle(s). In an advantageous case said nozzle(s) is (are) also used to ensure the detaching of a front end of a passing workpiece from the outer surface of the plate cylinder.

Wetting liquid dosing control, illustrated as 523, can be used to wet a portion of the cleaning web before—or simultaneously with—pressing it against the outer surface of the plate cylinder. Since also interrupting the wetting can be considered to go under wetting liquid dosing control 523, it has also a role in the method step where, after pressing a wetted portion of the cleaning web against the outer surface of the plate cylinder, a dry portion of the cleaning web (which is dry because the delivery of wetting liquid was interrupted) is pressed against the outer surface of the plate cylinder.

Figure 6:
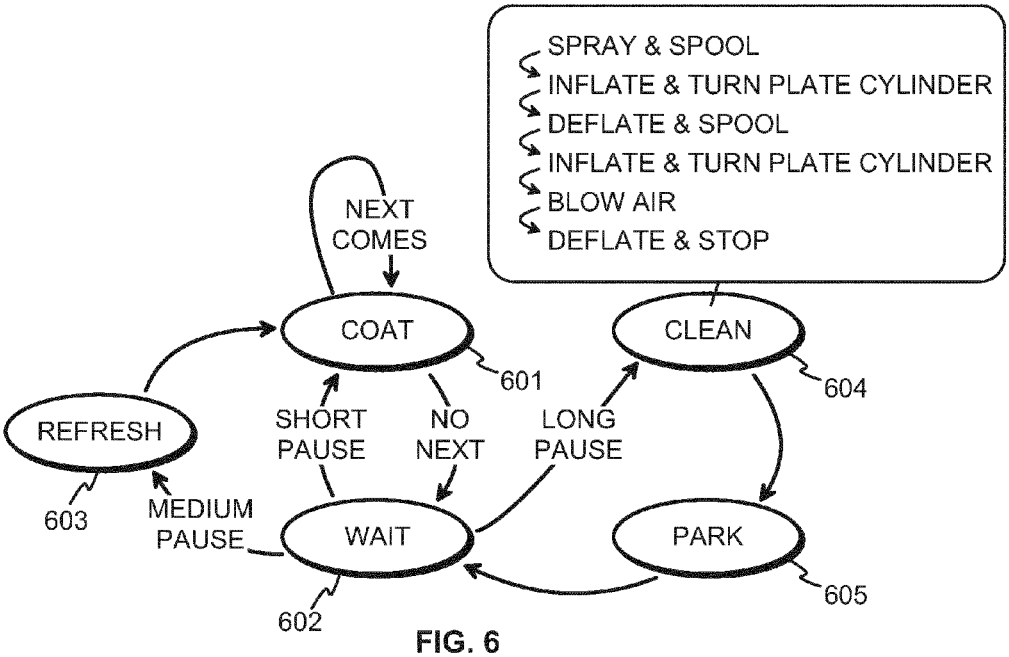

FIG. 6 illustrates a method according to an embodiment of the invention in the form of a simplified state diagram of a coater arrangement. State 601 corresponds to coating a workpiece, i.e., using a plate cylinder to spread coating substance onto a workpiece. If a next workpiece comes in directly thereafter, there is no transition to another state but just a loop into the state itself, as illustrated by the curved arrow in the top part of FIG. 6. If a next workpiece is not immediately following the previous one, a state transition occurs to the wait state 602, at which the coater waits for the next workpiece to come in.

To which further state a transition occurs from the wait state 602, depends on how long it takes for the next workpiece to arrive. If the waiting period is only short, a transition to the coating state 601 can be made directly, because the coater is in complete readiness to begin the coating of the next workpiece. However, during the waiting period, the coating substance that was left on the surface of the plate cylinder is drying all the time. After the waiting period has lasted longer than a first threshold, the layer of coating substance on the surface of the plate cylinder has become so dry that trying to transfer it onto the next workpiece could result in suboptimal quality of the coating. Therefore, if the waiting period had some medium length, information about the arrival of a next workpiece causes a transition to a refresh state 603, in which some fresh coating agent is dosed on the surface of the plate cylinder before the coating of the next workpiece can begin.

If the waiting period becomes still longer and no information is still received about the arrival of a next workpiece, there occurs, after a second threshold that is longer than said first threshold, a transition from the wait state 602 to a cleaning state 604. During the cleaning state 604, the coater executes a method for cleaning a coating unit according to an embodiment of the invention, in order to prevent the remaining coating substance from solidifying on the surface of the plate cylinder and in order to ensure optimal condition of the surface of the plate cylinder before coating the next workpiece. An example of the method steps to be taken is shown in the upper right part of FIG. 6. The illustrated steps are:

spray and spool: a portion of the cleaning web is wetted before—or simultaneously with—pressing it against the outer surface of the plate cylinder, and the spool is rotated to ensure that the wetted portion reaches a location where it can be pressed against the outer surface of the plate cylinder inflate and turn the plate cylinder: a radial moving mechanism (here: an inflatable cushion) is used to press the wetted portion of the cleaning web against the outer surface of the plate cylinder deflate and spool: the radial moving mechanism is used to temporarily detach the cleaning web from the outer surface of the plate cylinder, and the spool is rotated to bring an unused portion of the cleaning web to a location where it can be pressed against the outer surface of the plate cylinder inflate and turn plate cylinder: the radial moving mechanism is used to press the unused (dry) portion of the cleaning web against the outer surface of the plate cylinder blow air: remnant wetting liquid is removed from the outer surface of the plate cylinder by blowing air towards it from a blower nozzle, preferably one that is also used during coating to ensure the detaching of a front end of a passing workpiece from the outer surface of the plate cylinder deflate and stop: the cleaning is ended by detaching the cleaning web from the plate cylinder and stopping the remaining movement (if any) of the feed roller and spool.

After the cleaning state 604, a transition occurs to a park state 605, in which the plate cylinder is prepared for beginning the next coating. The name "park state" comes from the fact that since the time that still needs to be waited before the next workpiece comes in is not known, it may be preferable to stop the plate cylinder, possibly after driving it into a point of its rotational movement that is optimal in view of starting its rotating motion for the next time.

The detailed embodiments that have been described above are not to be construed as limiting the scope of protection since variations with the scope of the invention will be apparent to those of ordinary skill in the art. As an example, even if a roll-to-roll embodiment has been shown for implementing the tangential movement of the cleaning web, it is possible to use, for example, a plate-like cleaning web or cleaning pad that can be moved within the plane that is defined by its planar form. Also, even if the blower nozzles have been specifically described as applicable to double use, this is not a requirement of the invention. Especially if the detaching of the front end of each coated workpiece from the plate cylinder can be ensured without an air knife, one or more blower nozzles can be designed solely for the purposes of removing remnants of the wetting liquid, in which case the nozzle(s) can be placed and formed in a way that most optimally serves that function.

What is claimed is:

1. A method for cleaning a coating unit, comprising the steps of:

interrupting coating operation by a means for spreading a coating substance onto the outer surface of a plate cylinder used to spread a coating substance onto workpieces, using a radial moving mechanism to press a cleaning web against an outer surface of the plate cylinder for performing a cleaning operation, rotating the plate cylinder to rub its outer surface against said cleaning web, wetting the cleaning web before it comes in contact with the outer surface of the plate cylinder, using a tangential moving mechanism in a direction tangential to said outer surface of the plate cylinder to bring an unused portion of said cleaning web to a location where it can be pressed against the outer surface of the plate cylinder, directing an air knife from one or more blower nozzles, that are spaced from the plate cylinder and the impression cylinder, in an operating direction toward a nip formed between the plate cylinder and an impression cylinder to remove remnant wetting liquid from the outer surface of the plate cylinder by blowing the air downward toward the impression cylinder, terminating cleaning operation, and resuming coating operation during which said air knife acts on an upper surface of a workpiece exiting said nip to ensure the detaching of a front end of the workpiece from the outer surface of the plate cylinder as the workpiece exits said nip.

2. A method according to claim 1, comprising the further step of:

after said use of the radial moving mechanism to press the cleaning web against the outer surface of the plate cylinder, and before a subsequent use of the tangential moving mechanism to bring an unused portion of the cleaning web to a location where it can be pressed against the outer surface of the plate cylinder, using the radial moving mechanism to temporarily detach the cleaning web from the outer surface of the plate cylinder.

3. A method according to claim 1, comprising the further step of:

wetting a portion of said cleaning web before—or simultaneously with—pressing it against the outer surface of the plate cylinder.

4. A method according to claim 3, comprising:

after pressing the wetted portion of the cleaning web against the outer surface of the plate cylinder, pressing a dry portion of the cleaning web against the outer surface of the plate cylinder.

5. A cleaning arrangement for a coater that comprises a plate cylinder and an impression cylinder, the cleaning arrangement comprising:

a cleaning web that has a cleaning surface and a back surface, a tangential moving mechanism configured to controllably move said cleaning web in at least one direction in a plane defined by said cleaning web, a radial moving mechanism configured to controllably move said cleaning web in at least one direction out of said plane, a wetting arrangement for wetting the cleaning web with wetting liquid before it comes in contact with the outer surface of the plate cylinder, a controller coupled to said tangential and radial moving mechanisms, said controller being configured to control the moving of said cleaning web in conformity with input signals received by said controller, and one or more blower nozzles with an operating direction directed toward a nip formed between said plate cylinder and said impression cylinder, said one or more blower nozzles being spaced from the plate cylinder and the impression cylinder and forming an air knife directed downward toward the impression cylinder, wherein the one or more blower nozzles are arranged before the cleaning arrangement in the operation direction of the plate cylinder for removing remnant wetting liquid from the plate cylinder during cleaning of the plate cylinder and for directing air toward an upper surface of a workpiece exiting said nip for detaching of a front end of the workpiece from the outer surface of the plate cylinder as it exits the nip during coating operation, wherein said radial moving mechanism comprises an inflatable cushion on the back surface side of said cleaning web, and a pressurized air dosing arrangement comprising a controllable valve for controlling supplying of pressurized air for inflating and deflating said inflatable cushion during said cleaning operation and for supplying of pressurized air to the one or more blower nozzles during said coating operation, and wherein the tangential moving mechanism comprises a feed roller, a spool parallel to said feed roller, and a motor configured to rotate at least said spool for winding the cleaning web unwound from said feed roller onto said spool, and a motor configured to rotate the feed roller.

6. A cleaning arrangement according to claim 5, wherein:

said plane is defined by a portion of said cleaning web drawn between said feed roller and said spool.

7. A cleaning arrangement according to claim 5, comprising:

one or more wetting nozzles with an operating direction directed towards the back surface of said cleaning web, and a wetting liquid dosing arrangement configured to controllably deliver wetting liquid through said one or more wetting nozzles towards the back surface of said cleaning web.

8. A cleaning arrangement according to claim 7, wherein:

the one or more wetting nozzles are located between said feed roller and spool, with said operating direction being towards a planar portion of said cleaning web drawn between said feed roller and said spool.

* * * * *